US005251281A

United States Patent [19]

Fravel, Jr.

[11] Patent Number: 5,251,281

[45] Date of Patent: Oct. 5, 1993

[54] ARM SUPPORTED PORTABLE ELECTRIC HEAT BLOWER

[76] Inventor: Clifford H. Fravel, Jr., 4313 Windlestraw La., Greensboro, N.C. 27410

[21] Appl. No.: 836,250

[22] Filed: Feb. 18, 1992

[51] Int. Cl.[5] ..... F24H 3/04; A47L 5/24; F04B 35/04

[52] U.S. Cl. ..... 392/384; 15/327.5; 15/344; 15/405; 34/97; 34/243 R; 126/271.1; 392/476; 417/234

[58] Field of Search ..... 392/379–385, 392/476–478; 34/96–101, 243 R; 15/344, 327.5, 405; 417/234; 126/271.1–271.3

[56] References Cited

U.S. PATENT DOCUMENTS

| | | | |
|---|---|---|---|
| 2,114,494 | 4/1938 | Hummel et al. | 392/384 X |
| 2,591,669 | 4/1952 | Bucknell et al. | 392/383 |
| 2,597,215 | 5/1952 | Wright et al. | 392/384 X |
| 2,668,315 | 2/1954 | Crosby | 15/344 |
| 2,778,919 | 1/1957 | Vicario | 392/384 X |
| 3,109,083 | 10/1963 | Meltzer | 126/271.1 X |
| 3,418,452 | 12/1968 | Grabner | 392/383 |
| 3,612,824 | 10/1971 | Berryman et al. | 392/383 |
| 4,132,507 | 1/1979 | Akiyama et al. | 417/234 |
| 4,138,827 | 2/1979 | Baugh et al. | 34/98 |
| 4,269,571 | 5/1981 | Shikutani et al. | 417/234 |
| 4,288,886 | 9/1981 | Siegler | 15/344 X |
| 4,366,368 | 12/1982 | Stephens, III . | |
| 4,451,951 | 6/1984 | Satoh | 15/330 |
| 4,461,055 | 7/1984 | Zerrer et al. | 117/234 X |
| 4,559,721 | 12/1985 | Hanna | 34/229 |
| 4,570,286 | 2/1986 | Ross | 15/327.5 |
| 4,644,606 | 2/1987 | Luerken et al. | 15/330 |
| 4,734,017 | 3/1988 | Levin | 417/366 |
| 4,884,314 | 12/1989 | Miner et al. | 417/234 X |
| 4,979,316 | 12/1990 | Belanger et al. | 34/243 C |
| 5,058,193 | 10/1991 | Appierto | 392/384 |

FOREIGN PATENT DOCUMENTS

| | | | |
|---|---|---|---|
| 686582 | 1/1940 | Fed. Rep. of Germany | 15/344 |
| 421405 | 3/1967 | Switzerland | 392/384 |
| 666971 | 2/1952 | United Kingdom | 15/405 |

*Primary Examiner*—Anthony Bartis

[57] ABSTRACT

A portable air blower is provided for use around the home for purposes of drying a freshly washed vehicle or the like. The blower is supported on top of the arm of the user and proximate the user's shoulder as the user's arm passes through a rigid loop support which stabilizes the blower on the user's arm. The blower can be so operated for extended periods without the user becoming exhausted. An electric motor powers a fan and electrical resistance coils heat the air which passes therethrough.

18 Claims, 1 Drawing Sheet

ARM SUPPORTED PORTABLE ELECTRIC HEAT BLOWER

BACKGROUND OF THE INVENTION

1. Field Of The Invention

The present invention pertains to portable blowers of the type which can be carried by an individual and used specifically for drying cars after washing and for other home uses.

2. Description Of The Prior Art And Objectives Of The Invention

In recent years electric and small internal combustion engine powered yard blowers have become increasingly popular for home use to clean gutters, blow leaves and debris from drives and walkways, and to "sweep" patios and decks. Such blowers generally have a handle on top of the engine or motor housing for transportation and balance during use. These blowers do not usually have heating elements since the large volume and velocity of air produced will blow and sufficiently dry most surfaces encountered. Smaller, hand held blowers with heating elements such as hair dryers, glue drying guns and the like in contrast do have small electric fan motors with electrical resistance heating coils to warm the air therefrom. Electric hair and glue drying tools are ordinarily light in weight and can be easily manipulated with a single hand of the user or held and lifted to any suitable angle during drying. Leaf and other types of yard blowers are often several times larger and may weigh six to ten (6–10) pounds and therefore are more difficult to manipulate, especially if the airstream produced is directed along any line, other than towards the ground.

A need has therefore long existed to provide a blower which is of the larger, leaf or yard type which can be manipulated as easily as a small, hand held hair dryer without unduly taxing the strength of the user. The present invention fills this need and one of its objectives is to provide a portable blower which compares in size to a conventional leaf blower yet which can be manipulated with the ease of a hair dryer.

It is yet another objective of the present invention to provide a portable blower which is worn on the arm of the user for stability and maneuvering purposes and which will not excessively drain the user's strength.

It is still another objective of the present invention to provide a portable blower which has a heating element and which is electrically operated with a trigger switch.

It is still another objective of the present invention to provide a portable blower which has an arcuate nozzle which is turned to the side to direct the air laterally for drying difficult to reach areas.

Various other objectives and advantages of the present invention become apparent to skilled in the art as a more detailed presentation is provided below.

SUMMARY OF THE INVENTION

The invention herein pertains to a portable blower which is electrically powered having a housing which encloses an electric motor and fan. Extending from the housing is an elongated conduit in fluid communication therewith. A nozzle is arcuately shaped and attaches to the conduit for delivering a relatively thin, wide yet powerful airstream therefrom. Heating elements positioned in the housing increase the temperature of the air which passes from the fan. Beneath the housing and conduit is positioned a loop support through which the user's arm can be placed to stabilize the blower and to grip a trigger handle and switch during use.

DESCRIPTION OF THE PREFERRED EMBODIMENT

Figure 3:
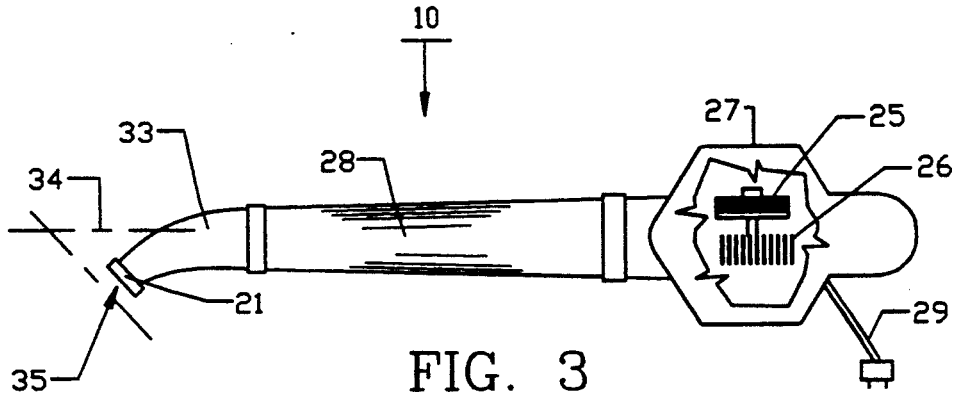
FIG. 3 illustrates a top view of the blower shown in FIG. 1.
Figure 2:
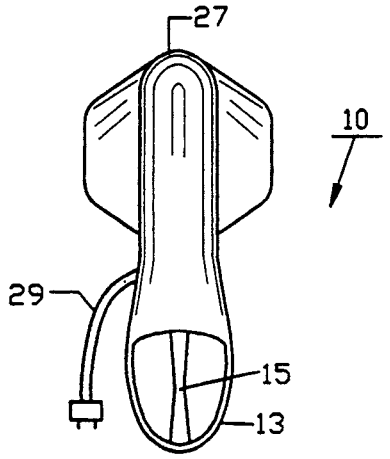
FIG. 2 demonstrates a rear view of the blower as seen in FIG. 1.
Figure 1:
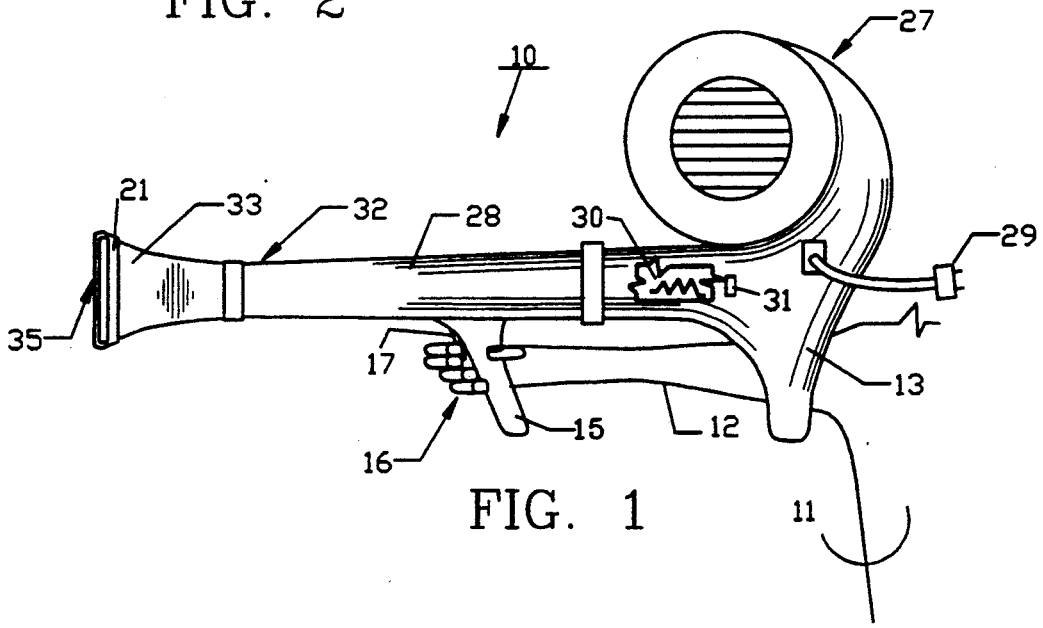
FIG. 1 shows a side view of the portable blower of the invention.

The preferred form of the invention is shown in FIGS. 1, 2 and 3 whereby a portable blower is shown which is electrically powered. The blower includes an electrical resistance coil which heats the air as it passes from the fan prior to entry into the elongated conduit which communicates with the main housing. A loop support depends from the main housing to receive the arm of the user for stabilizing the blower during operation. A pistol grip type handle is provided with a trigger switch to turn the fan motor on and off. The nozzle opening is surrounded with a resilient rim such as made from rubber and the nozzle curves approximately forty-five degrees (45°) at the end from the longitudinal axis of the conduit. In use the blower can be rotated on its side whereby the arcuate nozzle facilitates reaching areas such as needed when blowing leaves or the like from gutters or for directing a stream of air downwardly into the grill work of an automobile.

DETAILED DESCRIPTION OF THE DRAWINGS AND OPERATION OF THE INVENTION

Turning now to the drawings, for a better understanding of the invention and its operation, portable blower 10 is seen in FIG. 1 on the arm 12 of user 11. Arm 12 passes through loop-like support 13, whereby hand 16 is able to grasp pistol grip 15. Said loop-like support 13 encircles arm 12 and stabilizes blower 10 during operation by securing it to arm 12. As further shown in FIG. 1, trigger switch 17 is positioned proximate pistol grip 15 for easy access. Thus in use, blower 10 can be easily turned on and off at the user's convenience while it is supported on arm 12 of the user.

As shown in FIG. 3 electric motor 25 which may be a variable speed, fractional horsepower 110V AC motor is connected to centrifugal type fan 26. As would be understood, a small internal combustion or other suitable type of engine or motor could also be employed as a means to drive fan 26. Electric motor 25 and centrifugal fan 26 are mounted within housing 27 which may be for example molded of a durable synthetic polymer or may be formed from cast aluminum or otherwise. Housing 27 communicates with conduit 28 to allow fan 26 to force air therethrough as electrical power such as 110V current is connected to electrical cord 29. Electrical heating element 30 is shown in FIG. 1 which will heat the air from centrifugal fan 26 prior to its passing into conduit 28 to provide warm drying air. Heater switch 31 provides a convenient on/off control for heating element 30 when needed. Joined to elongated conduit 28, at the distal end 32 thereof is arcuate nozzle 33. As seen in FIG. 3, nozzle 33 is curved approximately forty-five degrees (45°) from the longitudinal axis 34 of conduit 28. The curvature of nozzle 33 allows blower 10 to reach hidden "pockets" of moisture such as may by found in gutters or other difficult to reach places. Nozzle 33 is flattened at its outlet end 35 and may have a height of six to eight (6–8) inches with an opening width of only three-quarters (¾) of an inch. Nozzle rim 21 may be formed from a relatively soft rubber or polymeric material such as a deformable polyvinyl chloride or other resilient synthetic materials. The use of said relatively soft plastics or deformable material prevents injury to vehicle enamels and other surfaces which rim 21 may accidentally contact during use.

To operate blower 10, the user attaches electric cord 29 to a suitable extension cord or electrical outlet which supplies conventional household current such as 110V AC. Next, the user's arm is placed through loop-like support 13 as seen from the rear in FIG. 2 and pistol grip 15 is then grasped. In order to dry a freshly washed vehicle or the like, trigger switch 17 is depressed whereby blower motor 25 and fan 26 are activated thereby forcing a stream of air through nozzle 33. If a heated stream of air is desired, switch 31 is turned to the "on" position and forced air is then heated. Blower 10 can be used for extended periods of time such as for drying a series of vehicles and due to the fact it is worn or supported on the arm, the arm is much less likely to become tired and the user exhausted.

The illustrations and examples provided herein are for explanatory purposes and are not intended to limit the scope of the appended claims.

I claim:

1. In a portable blower of the type having means for driving a fan in a housing for forcing air through an elongated conduit joined to the housing, the improvement comprising: means to stabilize the blower on top of the arm of the user proximate the user's shoulder, said stabilizing means comprising a rigid loop-like support, said support laterally affixed to said housing to allow the arm of the user to pass therethrough.

2. The portable blower of claim 1 and including means for the user to grip the blower, said gripping means affixed to said elongated conduit forward of said housing.

3. The portable blower of claim 2 and including a trigger switch, said trigger switch proximate said gripping means.

4. The portable blower of claim 3 wherein said trigger switch is connected to said motor.

5. The portable blower of claim 1 and including a means to heat said forced air, said heating means positioned within said housing.

6. The portable blower of claim 1 and included an arcuate nozzle, said nozzle joined to said elongated conduit.

7. The portable blower of claim 6 wherein said nozzle is curved in a direction lateral to the direction of the air flow through said elongated conduit.

8. The portable blower of claim 6 wherein said nozzle includes a rim, said rim formed from a resilient material.

9. The portable blower of claim 8 wherein said nozzle rim is formed from a deformable synthetic polymer.

10. The portable blower of claim 9 wherein said nozzle rim is formed from a polyvinyl chloride composition.

11. In a portable blower having means for driving a fan, a heater, said drive means, heater and fan contained within a housing, said housing joined to a conduit for directing air from the fan therethrough, the improvement comprising: means to stabilize said blower on top of the arm of the user proximate the user's shoulder, said stabilizing means comprising a loop-like support, said support integrally formed with said housing, said support for receiving the arm of the user, said stabilizing means positioned laterally across the underside of said housing.

12. The blower of claim 11 and including means to grip the housing, said gripping means positioned on said conduit forward of said housing in alignment with said stabilizing means.

13. The blower of claim 12 and including a trigger switch, said trigger switch pivotally affixed proximate said gripping means.

14. The blower of claim 12 and including a deformable nozzle rim, said nozzle rim affixed to said conduit.

15. The blower of claim 14 wherein said nozzle is arcuately shaped.

16. The blower of claim 15 and including a resilient nozzle rim.

17. In a portable electric blower having an electric motor and heater, said motor for driving a fan, said motor, heater and fan contained within a housing, said housing joined to a conduit for directing air from the fan therethrough, the improvement comprising: means to stabilize said blower, said stabilizing mean comprising a rigid loop support, said support positioned laterally on said conduit for receiving the arm of the user to maintain the blower on top of the user's arm proximate the user's shoulder, said stabilizing means positioned on the underside of said conduit, a means by which to grip the blower, said gripping means positioned on said conduit forward of said stabilizing means, a switch, said switch proximate said gripping means for controlling said motor.

18. The blower of claim 17 and including an arcuate nozzle.

* * * * *